United States Patent [19]

Pisoni

[11] 4,264,292

[45] Apr. 28, 1981

[54] PRESS FOR MOLDING MATERIALS HAVING A PASTY CONSISTENCY, SUCH AS SOAP CAKES

[75] Inventor: Ottorino Pisoni, Busto Arsizio, Italy

[73] Assignee: Meccaniche Moderne S.p.A., Busto Arsizio, Italy

[21] Appl. No.: 42,032

[22] Filed: May 24, 1979

[30] Foreign Application Priority Data

May 31, 1978 [IT] Italy ..... 24063 A/78
Feb. 21, 1979 [IT] Italy ..... 20403 A/79

[51] Int. Cl.[3] ..... C11D 13/18; B30B 3/00

[52] U.S. Cl. ..... 425/236; 425/233; 425/806; 425/340; 425/215; 425/218; 425/259

[58] Field of Search ..... 425/340, 341, 357, 358, 425/360, 361, 383, 394, 397, 400, 233, 236, 395, 806 R, 215, 216, 218, 259

[56] References Cited

U.S. PATENT DOCUMENTS

| | | | |
|---|---|---|---|
| 2,995,778 | 8/1961 | Hill | 425/806 R X |
| 3,142,863 | 8/1964 | Mazzoni | 425/236 |
| 3,271,834 | 9/1966 | Mazzoni | 425/806 R X |
| 3,299,193 | 1/1967 | Vergara | 425/806 R X |
| 3,357,072 | 12/1967 | Sutphin | 425/395 |
| 3,574,904 | 4/1971 | Mazzoni | 425/233 X |
| 4,138,086 | 2/1979 | Mizutani et al. | 425/806 R X |

*Primary Examiner*—J. Howard Flint, Jr.
*Attorney, Agent, or Firm*—Haseltine and Lake

[57] ABSTRACT

A molding press for soap cakes is provided which comprises a vertical plate rotating about a horizontal axis and having mold cavities on one or both front surfaces thereof.

The rotating plate is driven step by step in three different stations, i.e. a first station in which soap blanks are pressed into the form cavities, a second station in which the soap blanks are molded and a third station in which the molded soap cakes are withdrawn. In order to anchor the soap blanks to the mold cavities through holes are provided intermediate each pair of cavities in which the excess soap material is pushed by the operation of the pressing means.

7 Claims, 9 Drawing Figures

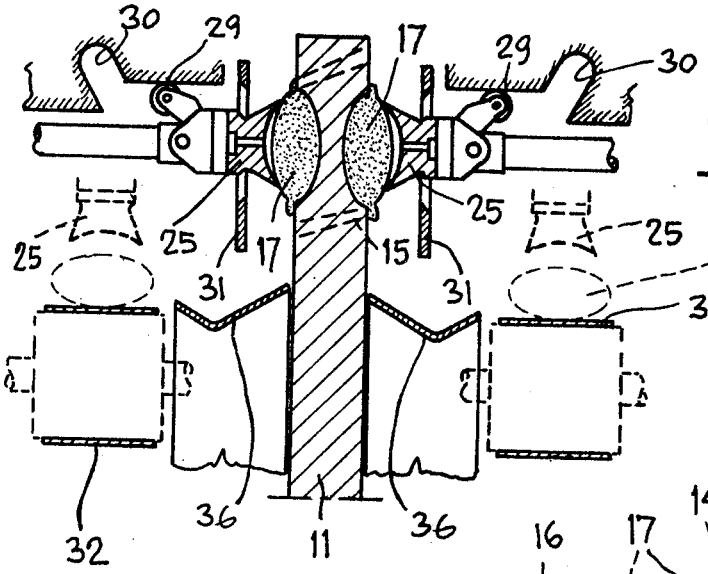
FIG. 7
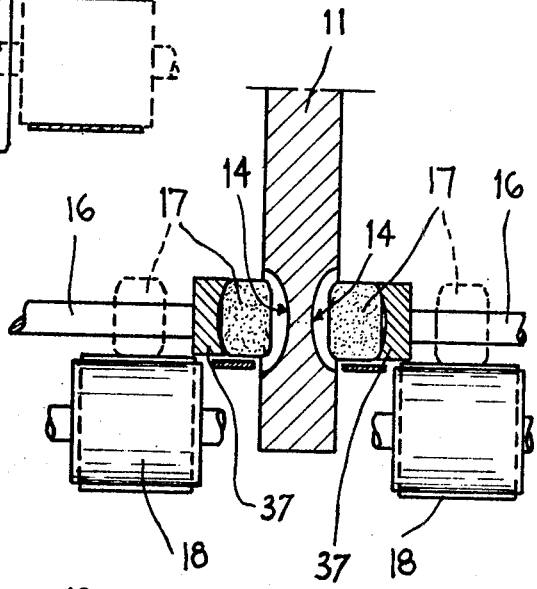
FIG. 8
FIG. 9
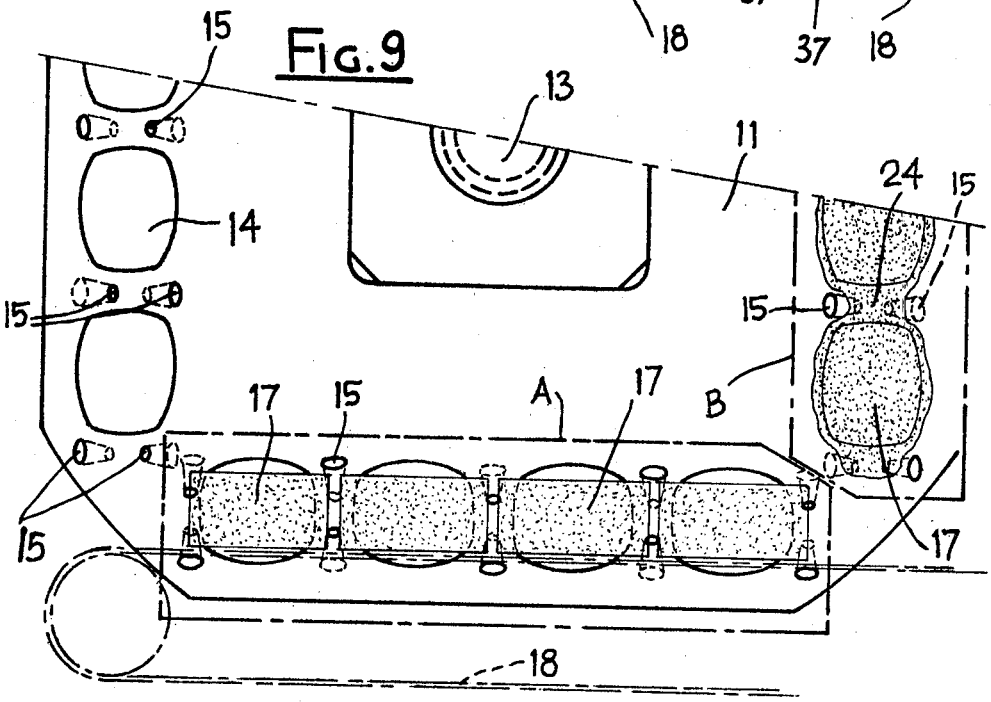

PRESS FOR MOLDING MATERIALS HAVING A PASTY CONSISTENCY, SUCH AS SOAP CAKES

This invention relates to a molding press for molding materials having a paste-like consistency, hereinafter referred to as "pasty materials", such as soaps or the like in any shape, particularly a biconvex shape, for example pieces of ovoidal shape so-called "blow-molded" and also pieces of parallelepiped shape so-called "box-molded". The box-moulded pieces can also be of any shape in cross-section.

It is known to mold prismatic pasty material pieces by molding a blank within openings provided in a plate rotating about a horizontal axis and in which dies move provided with engraved front surfaces for stamping the pieces on the upper and lower surfaces thereof.

Dies in the openings accomplish the closing and opening strokes of the mold rotating about the horizontal axis; thus, it is possible, by rotating the plate step by step, to bring the dies provided thereon to different operating stations, such as blank feeding, blank pressing and molded piece withdrawing stations.

In these prior art presses which mold prismatic-shaped pieces of pasty materials it is obvious that the piece readily remains in the molding box of the plate by inherent adhesion; problems arise when it is desired to obtain non-prismatic shaped pieces or the like, e.g. convex shaped pieces.

The provision of horizontal plate presses, which are more complex, results in various practical difficulties. Among these there is the effort of the manufacturer to standardize the basic structure of the press so that it is capable of molding pieces of any shape by interchanging the dies only.

It has also been proposed to provide presses for molding pieces of different shape having the pasty material pieces to be molded arranged on a vertical rotating plate by providing an additional generally disc-shaped element having as the main function that of retaining on the rotating plate the material to be molded. It should be understood that it is not easy to retain the molded piece on the rotating plate in a desired position when the two dies forming the mold after the pasty material piece has been molded are to be simultaneously moved away for releasing the molded piece unless there are left attached to the piece perimetral flashes having such a thickness as to be readily visible on the finished piece, even if cut away.

This invention proposes a solution to the problem of retaining the pasty material to be molded against mold cavities directly provided on the front surface of a vertical rotating plate, without the need to provide additional retaining means so as to obtain an improved molding press as simple from the construction standpoint as that used for molding prismatic pieces, with the attendant advantages of operation reliability.

According to the invention a press for molding a material having a pasty consistency, particularly soap, of the type comprising a vertical plate rotating step by step about a horizontal axis in order to bring mold cavities provided on one or both front surfaces of the rotating plate to a first station in which pressing means are provided for pressing blanks of pasty material against the mold cavities, a second station in which movable dies are provided having mold cavities complementary to the cavities of the rotating plate and cooperating with mold cavities of the rotating plate for molding the blanks, a third station in which means are provided to remove the molded pieces, is characterized in that adjacent each mold cavity of the rotating plate through holes are provided in which the pasty material in excess flows during the operation of the blank pressing means and the movable dies.

In order to better understand the objects and the features of this invention several embodiments of the invention will be described by way of example only in connection with the accompanying drawings, wherein:

FIG. 7, is a partial cross-section of a withdrawing device and associated pick-up means for the molded pieces;

FIG. 8, is a partial cross-section of a device for pressing the blanks against the mold cavities of the rotating plate; and FIG. 9, is a partial front view of the rotating plate provided with mold cavities on both front surfaces.

This invention will be now described as applied to the production of soap-cakes, it being however understood that it can be applied to the production of molded pieces of any pasty materials.

As can be seen, on the press structure 10 a rotating plate 11 is mounted, which is provided on a front surface (FIGS. 1 and 2) or on both the front surfaces thereof (FIGS. 3–9) with mold cavities 14.

The rotating plate 11 is supported on a center pin 13 which permits the rotating plate to be rotated by steps of 90°.

Figure 2:
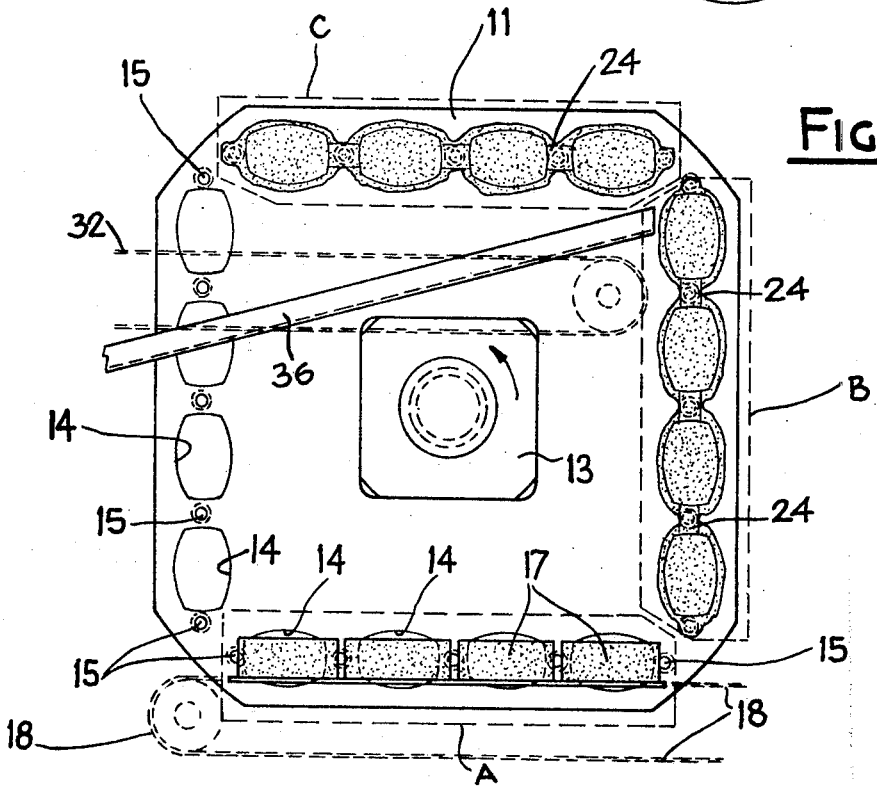
FIG. 2, is a sectional view taken along the line II—II in FIG. 1.
Figure 3:
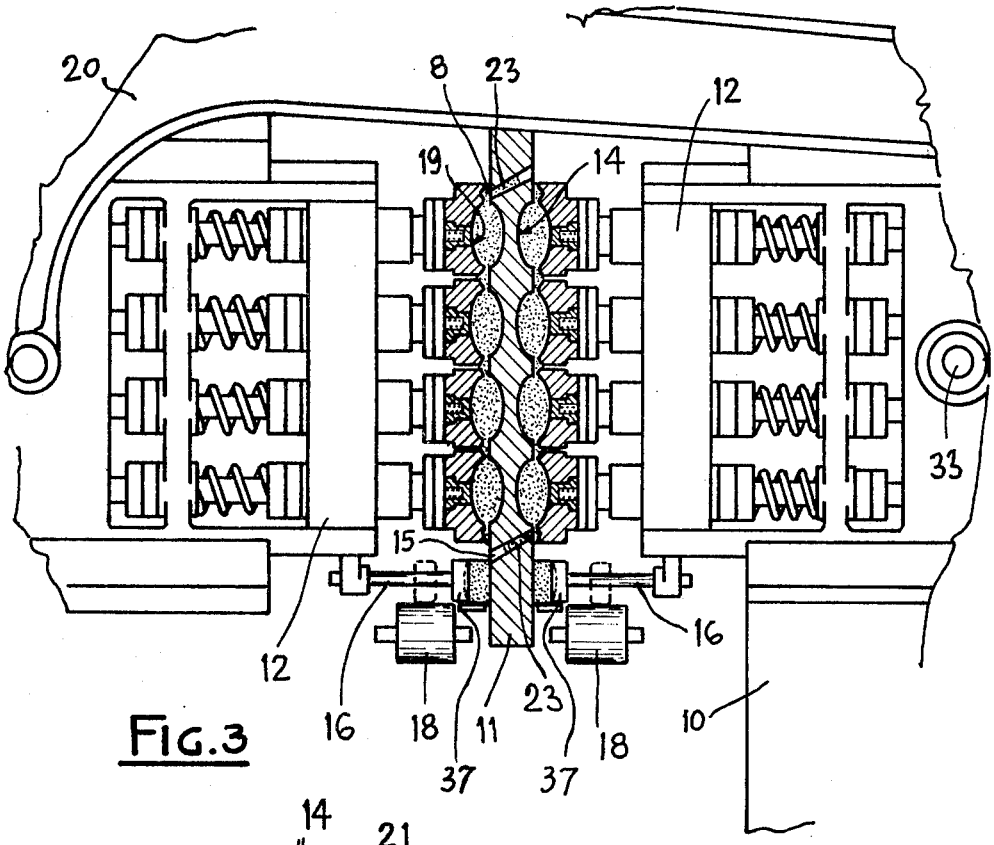
FIG. 3, is a view partially in elevation and partially in section showing a press according to the invention having mold cavities provided on both front surfaces of the rotating plate, during the molding step.
Figure 4:
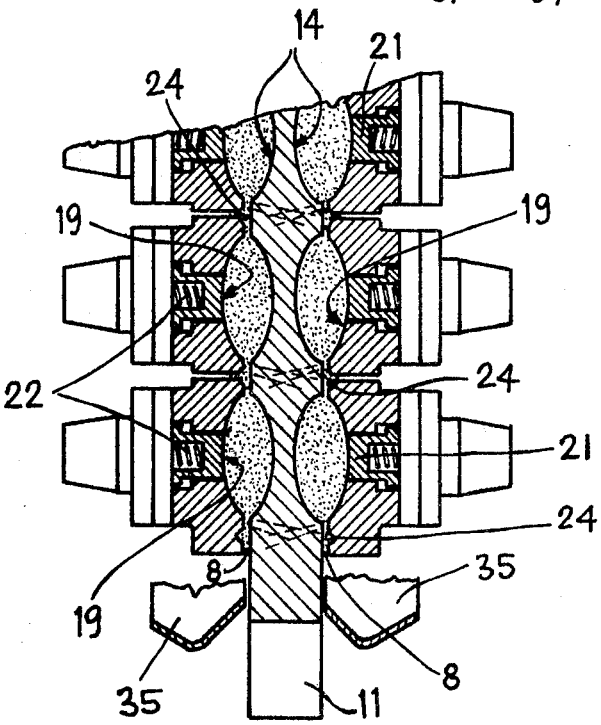
FIG. 4, is a partial vertical section of the rotating plate and the movable dies of FIG. 3, during the molding step in the second station.
Figure 5:
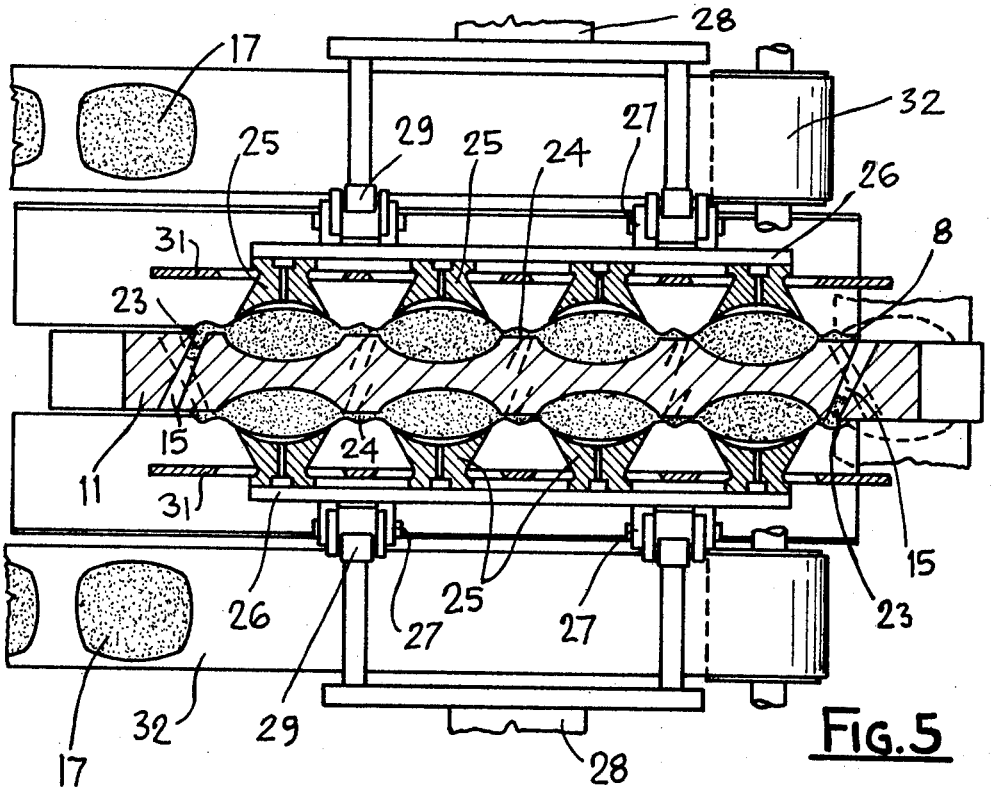
FIG. 5, is a plan view partially cut away of the rotating plate of FIG. 3, during the withdrawing step of the molded pieces at the third station.
Figure 6:
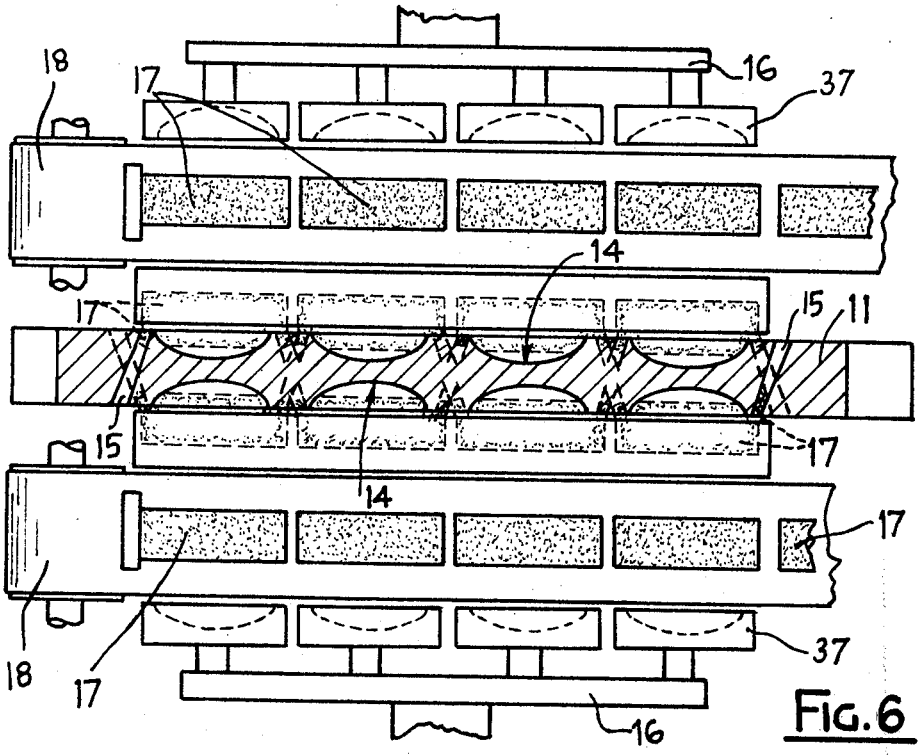
FIG. 6, is a plan view, partially cut away, of the rotating plate provided with mold cavities on both the front surfaces thereof at the first station where pressing of the blanks against the mold cavities by the movable dies occurs.

It is seen from the FIGS. 2 and 9 that on the rotating plate 11 four sets of four mold cavities 14 are provided having therebetween through holes 15.

For sake of clarity three typical positions of the form cavities on the rotating plate are indicated, which are shown in dotted lines at A, B and C and which correspond to three operation steps in molding the soap material.

Figure 1:
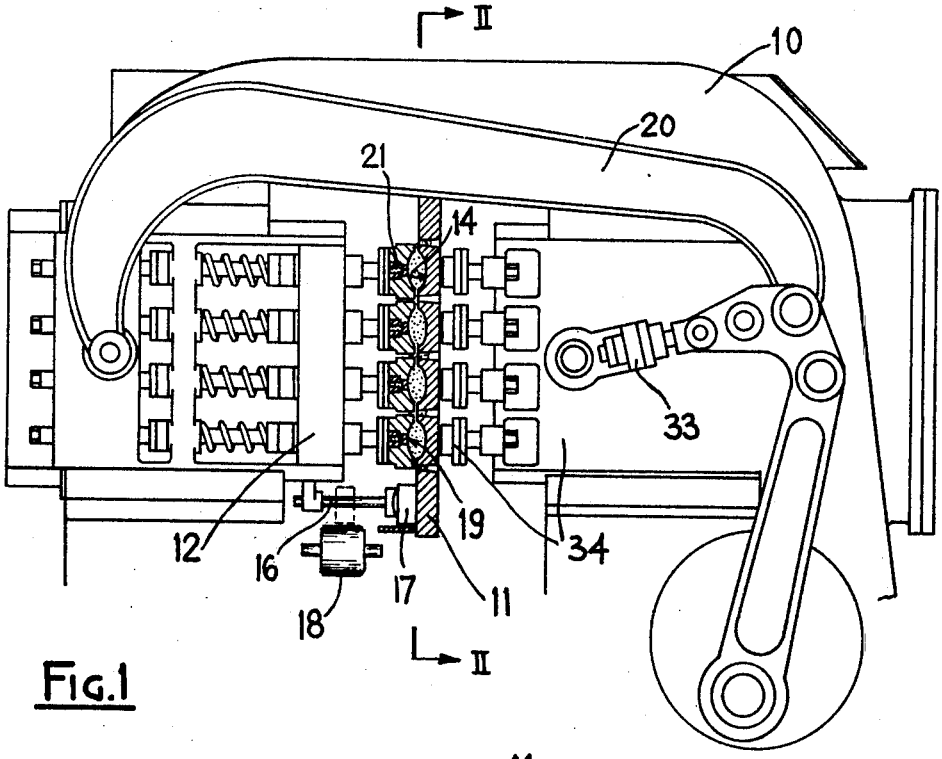
FIG. 1, is an elevation view partially cut away showing a press according to the invention, having a single set of mold cavities provided on the front surface of the rotating plate.

The mold cavities provided at A are aligned with pressing means 16 carried by a slide 12 in the case of the plate of FIGS. 1 and 2 and by two opposite slides 12 in the case of the plate of FIGS. 3–9, acting in the direction to press blanks 17 placed on belt conveyors 18 against the mold cavities 14. In FIGS. 2 and 9 there is diagrammatically illustrated how soap blanks 17, comprised of an amount of soap material exceeding that necessary to the molding operation, are pressed against the mold cavities 14, partially filling them and how the excess amount of material is forced within the through holes 15.

It should be appreciated that the pressing means 16 can be simple flat elements adapted to push the blanks 17 against the mold cavities 14 in the rotating plate 11 or else they can be shell-shaped elements 37 (FIG. 3) the recesses of which have such a shape and size as to perform a premolding of the blanks.

It should be also appreciated that the soap material is not yet efficiently retained within the mold cavities 14 since they have a convex wall and the plane tangent to every point thereof forms an angle smaller than 90° with respect to the plane of the rotating plate 11, i.e. the vertical plane.

On the contrary, the soap material being inserted into the through holes 15 anchors therein due to the form of the hole walls. The anchoring action can be enhanced by conically tapering the through holes 15 towards the opposite front surface of the rotating plate. However, a simple cylindrical form of the holes 15 can provide a sufficient anchoring action.

In the case of a rotating plate provided with mold cavities on a front surface only (see FIGS. 1 and 2) the through holes 15 are positioned intermediate the mold cavities and aligned thereto (FIG. 2), whereas in the case of a rotating plate provided with mold cavities on both the front surfaces (see FIGS. 3–9), said through holes 15 are preferably positioned in an alternate arrangement.

More particularly, if on one front surface of the rotating plate 11 there is the inlet of a through hole 15, this hole 15 will extend inwardly in the rotating plate 11 with its axis inclined to diverge from the plate axis and the outlet thereof will be on the opposite front face of the rotating plate at the periphery thereof, while adjacent the above mentioned inlet there will be the outlet of another through hole 15, whose inlet will be on the above mentioned opposite front surface of the rotating plate 11, whereby the axes of two adjacent through holes are inclined in opposite directions.

Accordingly, on a front surface of the plate 11, between a mold cavity 14 and the next one there will be the inlet of a through hole 15 aligned with the cavities and the outlet of the corresponding through hole 15 originating from the opposite front surface of the plate 11, offset towards the periphery of said plate, with the axes of the through holes 15 being inclined so as to diverge from the rotating plate axis in the direction from the inlet to the outlet of the holes in order to permit the excess soap material to be discharged therefrom without interfering with the next pressing steps of the blanks.

Once the operation of the pressing means 16 is terminated, a blank 17 is firmly anchored to each of the mold cavities 14 in location A.

The rotating plate 11 is then rotated by 90° so as to bring the filled mold cavities 14 into location B. In this location the mold cavities 14 lie in mating relationship with complementary movable dies 19 mounted to the slide or slides 12. These movable dies are known per se and will not be described in more detail. Particularly, it is to be noted that the movable dies have a wall portion 21 yieldably mounted by means of a spring 22 which aids the withdrawal therefrom of the molded soap material so that it remains within the mold cavities 14.

The purpose of the premolding obtained by means of the pressing means 16 and 37 is to improve the final molding operation accomplished by the complementary dies 19. In this manner the molding operation is improved in that a possible air cushion which would prevent the blanks 17 from adhering to the dies during the pressing step will be eliminated both during the actuation of the pressing means 16, 37 and during the actuation of the dies 19.

It is also advantageous that the dies 19 have a light perimetral depression 8 on the land between each of these dies and the adjacent through holes 15; in this manner a very thin flash 23 which can be formed circumferentially around the mold cavity by the excess material 17 fed to the final molding operation will have a small area of greater thickness 24 which will strengthen the bond between the material molded in the mold cavities 14 and dies 19 and the material pushed into the through holes 15.

After the molding operation is ended and the movable dies 19 are retracted, the rotating plate 11 rotates by further 90° so as to bring the mold cavities 14 into location C (FIGS. 2 and 5), in which location the mold cavities face pick-up suction cups 25 carried by one or more fingers 26 pivotally connected at 27 to a stem 28 secured to the slides 12. Rollers 29 fixed to the fingers 26 cooperate with guide means 30 so as to bring the suction cups into horizontal position when the suction cups 25 are moved towards the rotating plate 11 (FIG. 7) and into a vertical position, shown in dotted line, when the suction cups 25 are moved away from the rotating plate 11.

Thus, a movement of the slide or slides 12 towards the rotating plate 11 will bring the suction cups 25 against the molded pieces and therefore a retraction of slides 12 will withdraw the molded pieces from the mold cavities 14 and move the molded pieces through cutting means 31 which remove the flashes 24 therefrom and finally bring them on conveyors 32 which transport the molded pieces to storage.

It should be appreciated that for every alternating stroke of slides 12 the operations at locations A, B and C are simultaneously performed so that for each movement of slides 12 soap cakes are molded in the same number as that of a mold cavity set, i.e. four for each front surface of the rotating plate in the described example.

The press having mold cavities on one surface only of the rotating plate 11 is also provided with a crank mechanism 33 which moves pushing means 34 against the slide 12 so as to abut the rotating plate 11 during the actuation of the pressing means 16 and the dies 19. On the contrary, in the case of presses having mold cavities 14 on both front surfaces of the rotating plate (FIG. 3) the pushing means 34 are substituted by other complementary dies 19.

The anchoring action performed by the excess material being pressed within the through holes 15 has proved very efficient. As the pressing operations of the soap material are repeated, the excess material which is pushed into the through holes 15 undergoes a drawing effect and flows out from the opposite front surface of the rotating plate where it is collected by scraping means 35 and the flashes still attached to the front surfaces of the rotating plate are scraped and collected by slide scraping means 36, together with the portions removed by the cutting means 31.

The embodiment of the invention having a single set of mold cavities 14 on one front surface of the rotating plate and the embodiment having a double set of mold cavities on both the front surfaces of the rotating plate are given by way of example only and it is apparent to those skilled in the art that various changes and modifications can be made thereto without departing from the scope of the invention. More particularly the number and the shape of the mold cavities in the rotating plate 11 can be changed and other pressing means 16 than those shown herein can be employed.

What I claim is:

1. A molding press for molding materials having a paste-like consistency, comprising a horizontally fixed vertical rotating plate having sets of mold cavities constituting first die halves on at least a front surface thereof and rotating about a horizontal axis step by step in order to bring said mold cavities into a first station in which pressing means are provided for pushing material blanks against said mold cavities, into a second station in which movable die halves are provided which mold the material in cooperation with said first die halves in the rotating plate and into a third station in which means are provided for withdrawing the molded material, wherein adjacent each mold cavity in the rotating plate through holes are provided in the rotating plate, in which excess material is pushed during the actuation of said pressing means of the blanks and the movable die halves.

2. A molding press according to claim 1, wherein said mold cavities are provided on both front surfaces of the rotating plate so as to double the operative stations of the press.

3. A molding press according to claim 1, wherein said through holes have a conical inner wall of a diameter increasing from the inlet to the outlet thereof.

4. A molding press according to claim 1, wherein said through holes are arranged along a center line between each pair of adjacent mold cavities.

5. A molding press according to claim 2, wherein said through holes are inclined with their axes diverging from the rotating plate axis from the inlet to the outlet and are arranged in alternate manner so as between each pair of adjacent mold cavities there is a through hole inlet aligned with the mold cavities and a through hole outlet offset towards the periphery of the rotating plate.

6. A molding press according to claim 1, wherein said pressing means are provided with recessed pads in order to accomplish a premolding operation.

7. A molding press according to claim 1, wherein each of said movable second die halves has a perimetral depression opposite the through holes in the rotating plate.

* * * * *